US005520582A

United States Patent [19]

Lathrop

[11] Patent Number: 5,520,582

[45] Date of Patent: May 28, 1996

[54] REMOVABLE BOWLING BALL THUMB INSERT

[76] Inventor: Edward J. Lathrop, 14 New St., New Milford, Conn. 06776

[21] Appl. No.: 368,976

[22] Filed: Jan. 5, 1995

[51] Int. Cl.[6] ..... A63B 37/00

[52] U.S. Cl. ..... 473/129; 473/130

[58] Field of Search ..... 473/127, 128, 473/129, 130

[56] References Cited

U.S. PATENT DOCUMENTS

| | | | |
|---|---|---|---|
| 4,892,308 | 1/1989 | Gaunt | 473/129 |
| 4,968,033 | 11/1990 | Aluotto | 473/128 |
| 5,118,106 | 6/1992 | Goldman | 473/129 |

*Primary Examiner*—William M. Pierce

[57] ABSTRACT

A bowling ball thumb insert including a generally planar plug having an upper surface, a lower surface, a peripheral edge interconnecting the surfaces and thereby defining a thickness, and a bore disposed therethrough and with the plug positionable within a thumb hole of a bowling ball; a plurality of sleeves with each sleeve having a circular planar bottom wall with an interior top surface, an exterior bottom surface, a peripheral edge extended between the surfaces, a bore disposed therethrough, and a tubular side wall having a characteristic thickness, an upper end, and a lower end with the lower end coupled with the interior surface of the bottom wall; and a bolt extended through the bore of a sleeve and the bore of the plug, the bolt further projected outwards from the lower surface of the plug for threaded securement to a complimentary threaded bore formed at a bottom end of a thumb hole of a bowling ball.

10 Claims, 4 Drawing Sheets

REMOVABLE BOWLING BALL THUMB INSERT

BACKGROUND OF THE INVENTION

1. Field of the Invention

The present invention relates to a removable bowling ball thumb insert and more particularly pertains to allowing a diametric extent of a thumb hole of a bowling ball to be changed with a removable bowling ball thumb insert.

2. Description of the Prior Art

The use of bowling ball finger and thumb inserts is known in the prior art. More specifically, bowling ball finger and thumb inserts heretofore devised and utilized for the purpose of allowing finger and thumb holes on a bowling ball to be changed are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,784,198 to Bach discloses a finger hole liner for a bowling ball. U.S. Pat. No. 3,805,394 to Marberg discloses a hole fit indicator for drilling a bowling ball. U.S. Pat. No. 4,530,502 to Yamane discloses a bowling ball including a thumb-hole insert. U.S. Pat. No. 5,123,644 to Berhardt discloses a finger insert for a bowling ball. U.S. Pat. No. 5,176,378 to Berhardt discloses a finger insert for a bowling ball. U.S. Pat. No. 5,308,061 to Bernhardt discloses a finger insert for a bowling ball.

While these devices fulfill their respective, particular objective and requirements, the aforementioned patents do not describe a removable bowling ball thumb insert that uses a plurality of sleeves for allowing adjustment of the diametric extent of a thumb hole of a bowling ball based on the extent of swelling of a bowler's thumb.

In this respect, the removable bowling ball thumb insert according to the present invention substantially departs from the conventional concepts and designs of the prior art, and in doing so provides an apparatus primarily developed for the purpose of allowing a diametric extent of a thumb hole of a bowling ball to be changed.

Therefore, it can be appreciated that there exists a continuing need for new and improved removable bowling ball thumb insert which can be used for allowing a diametric extent of a thumb hole of a bowling ball to be changed. In this regard, the present invention substantially fulfills this need.

SUMMARY OF THE INVENTION

In the view of the foregoing disadvantages inherent in the known types of bowling ball finger and thumb inserts now present in the prior art, the present invention provides an improved removable bowling ball thumb insert. As such, the general purpose of the present invention, which will be described subsequently in greater detail, is to provide a new and improved removable bowling ball thumb insert and method which has all the advantages of the prior art and none of the disadvantages.

To attain this, the present invention essentially comprises, in combination, a rigid circular planar plug having a fixed diameter, an upper surface, a lower surface, a peripheral edge perpendicularly interconnecting the surfaces and thereby defining a thickness, an axial threaded bore disposed therethrough, and a straight cylindrical guide pin coupled thereto and extended upwards from the upper surface. The plug further includes a diameter allowing it to be snugly received within a thumb hole of a bowling ball and with the lower surface and peripheral edge thereof in facing contact with adjacent corresponding surfaces of a bowling ball located adjacent to its thumb hole.

A first, a second, a third, and a fourth rigid sleeve are provided. Each sleeve includes a circular planar bottom wall. Each bottom wall of each sleeve has an interior top surface, an exterior bottom surface, a peripheral edge perpendicularly extended between the surfaces, an axial threaded bore disposed therethrough, and a cylindrical recess formed on the exterior surface at a location for snugly receiving the guide pin of the plug therein. Each sleeve also includes a tubular side wall. Each side wall of each sleeve has a circular cross section, a length at least ten times greater than the thickness of the plug, an interior diameter, a fixed exterior diameter equal to the diameter of the bottom wall, an interior surface, an exterior surface, a thickness defined as a tangential distance between the interior surface and the exterior surface, a lower end integral with the interior surface of the bottom wall, and an upper end shaped to conform and remain flush with the radius of curvature of a rolling surface of a bowling ball. Each sleeve is slidably frictionally positionable within a thumb hole of a bowling ball. The first sleeve has a sidewall with a thickness of about 1/64 inch. The sidewall of the second sleeve has a thickness of about 2/64 inch. The sidewall of the third sleeve has a thickness of a about 3/64 inch. Lastly, the sidewall of the fourth sleeve has a thickness of about 4/64 inch.

A rigid planar washer is included. The washer is disposed within the sleeve upon the top surface of the bottom wall. It is axially aligned with the bore of the bottom wall. Lastly, a rigid bolt is included. The bolt has a hexagonal head with an elongated threaded portion extended outwards therefrom. The threaded portion of the bolt is extended through the washer and threadedly extended through a bore of one of the sleeves and the bore of the plug. The threaded portion of the bolt is further projected outwards from the lower surface of the plug for threaded securement to a complimentary threaded bore formed at a bottom end of a thumb hole of a bowling ball.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved removable bowling ball thumb insert which has all the advantages of the prior art bowling ball finger and thumb inserts and none of the disadvantages.

It is another object of the present invention to provide a new and improved removable bowling ball thumb insert which may be easily and efficiently manufactured and marketed.

It is a further object of the present invention to provide a new and improved removable bowling ball thumb insert which is of durable and reliable construction.

An even further object of the present invention is to provide a new and improved removable bowling ball thumb insert which is susceptible of a low cost of manufacture with regard to both materials and labor, and which accordingly is then susceptible of low prices of sale to the consuming public, thereby making such a removable bowling ball thumb insert economically available to the buying public.

Still yet another object of the present invention is to provide a new and improved removable bowling ball thumb insert which provides in the apparatuses and methods of the prior art some of the advantages thereof, while simultaneously overcoming some of the disadvantages normally associated therewith.

Even still another object of the present invention is to provide a new and improved removable bowling ball thumb insert comprising a generally planar plug having an upper surface, a lower surface, a peripheral edge interconnecting the surfaces and thereby defining a thickness, and a bore disposed therethrough and with the plug positionable within a thumb hole of a bowling ball; a plurality of sleeves, each sleeve having a circular planar bottom wall with an interior top surface, an exterior bottom surface, a peripheral edge extended between the surfaces, a bore disposed therethrough, and a tubular side wall having a characteristic thickness, an upper end, and a lower end with the lower end coupled with the interior surface of the bottom wall; and a bolt extended through the bore of a sleeve and the bore of the plug, the bolt further projected outwards from the lower surface of the plug for threaded securement to a complimentary threaded bore formed at a bottom end of a thumb hole of a bowling ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
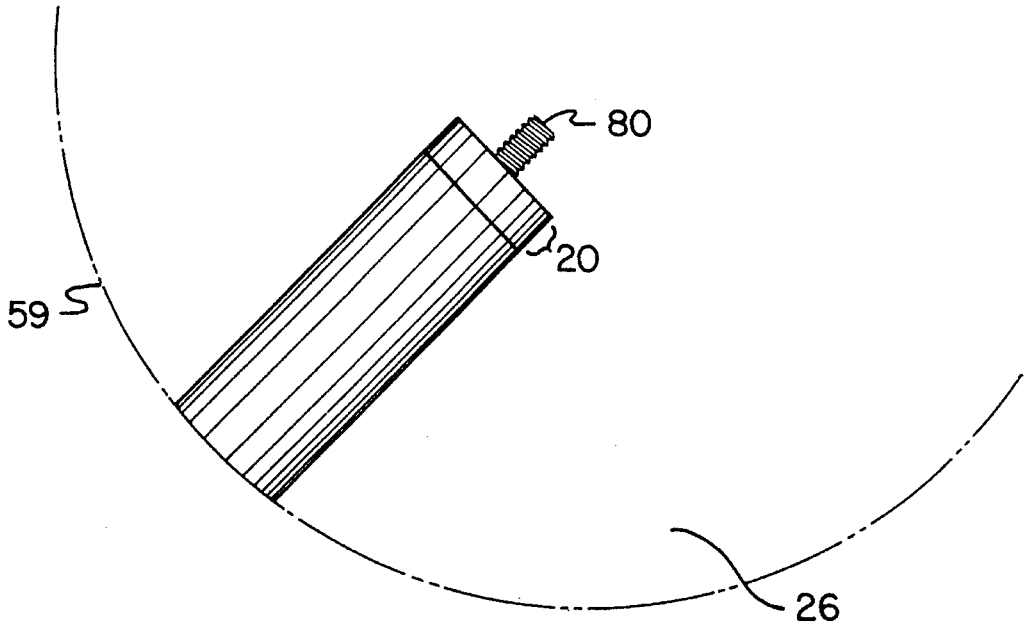
FIG. 2 is a side elevational view of the preferred of the present invention.
Figure 3:
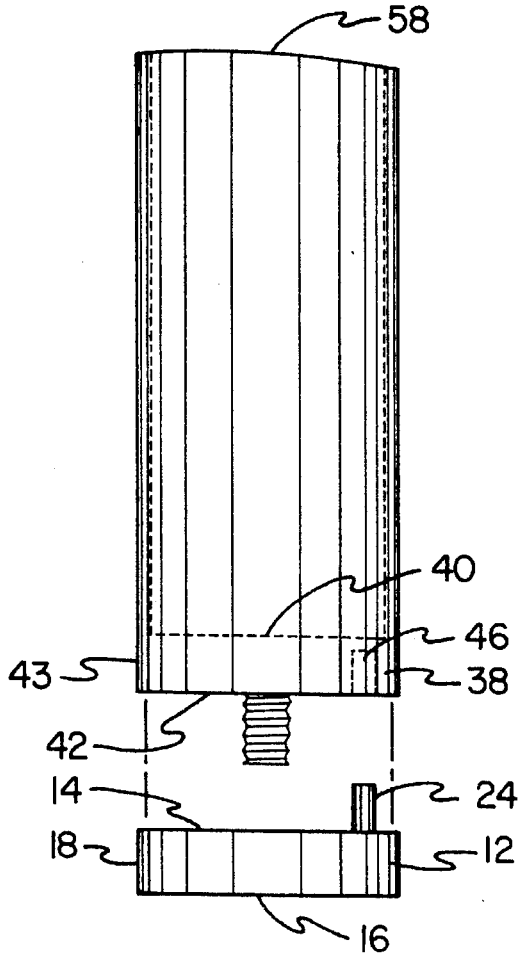
FIG. 3 is an exploded side elevational view of the present invention.
Figure 4:
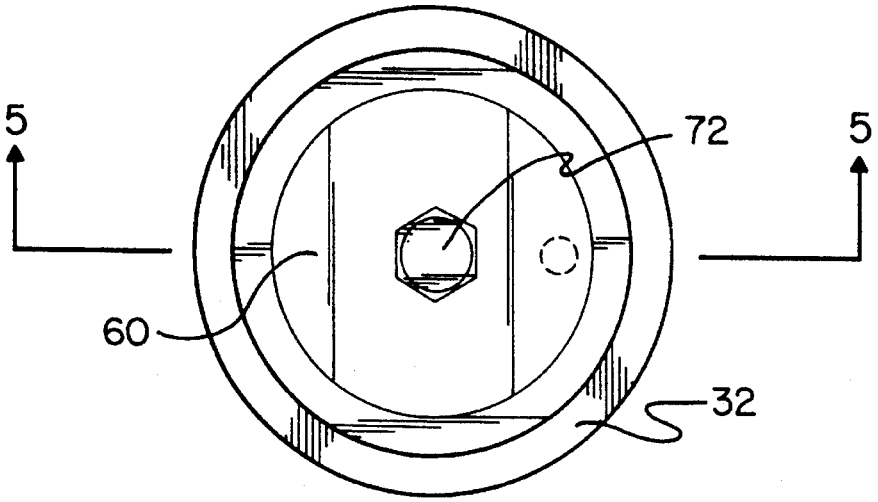
FIG. 4 is a plan view of the present invention as viewed axially downwards.

With reference now to the drawings, and in particular, to FIGS. 2 through 4 thereof, the preferred embodiment of the new and improved removable bowling ball thumb insert embodying the principles and concepts of the present invention and generally designated by the reference number 10 will be described.

The present invention is comprised of a plurality of components. In their broadest context, such components include a plug, a plurality of sleeves, a washer and a bolt. Such components are individually configured and correlated with respect to each other to provide the intended function of allowing the diametric extent of a thumb hole on a bowling ball to be changed.

Figure 5:
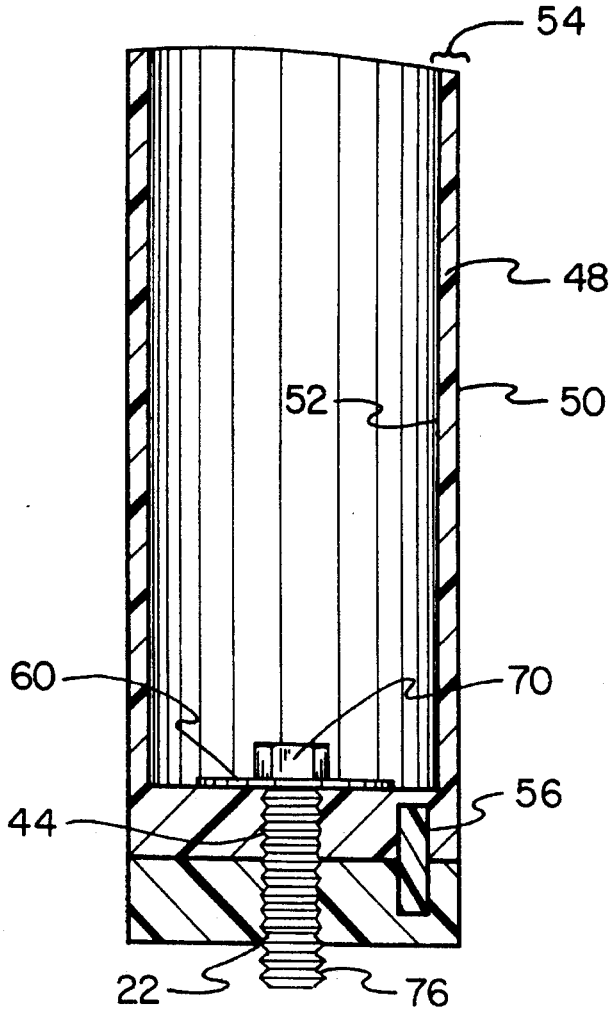
FIG. 5 is a cross-sectional view of the present invention taken along the line 5—5 of FIG. 4.
Figure 6:
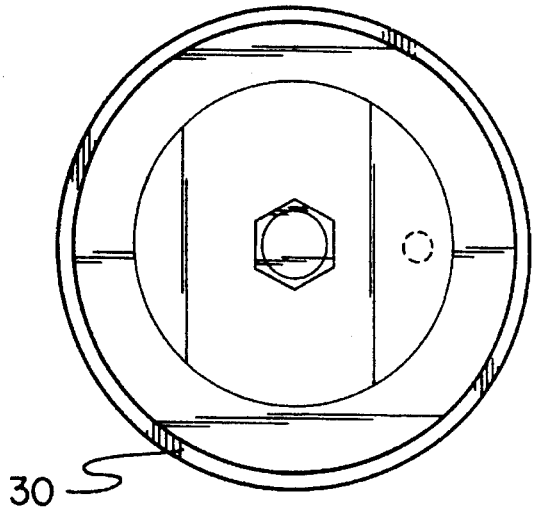
FIG. 6 is a plan view of the present invention with a side wall of a given thickness.
Figure 7:
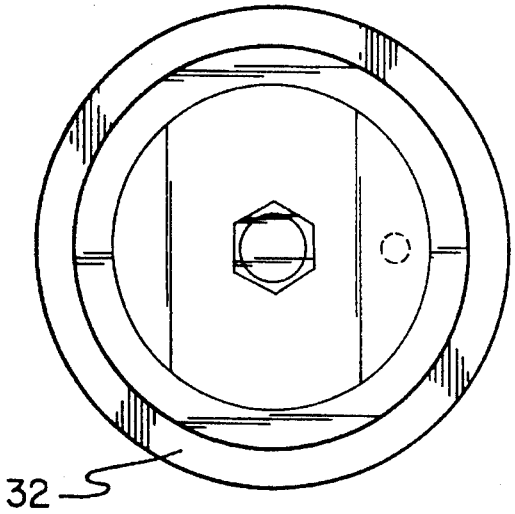
FIG. 7 is a plan view of the present invention with the side wall of the body having a thickness 1/64 inch larger than that shown in FIG. 6.
Figure 8:
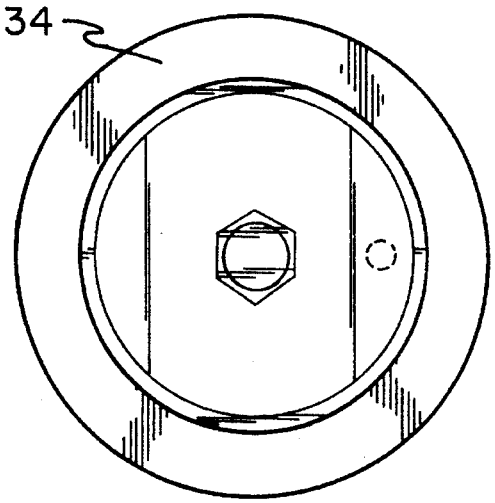
FIG. 8 is a plan view of the present invention with the side wall of the body having a thickness 1/64 inch larger than that shown in FIG. 7.
Figure 9:
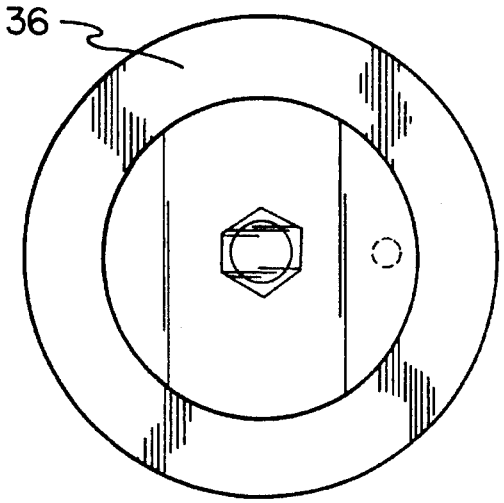
FIG. 9 is a plan view of the present invention with the side wall of the body having a thickness 1/64 larger than that shown in FIG. 8.

Specifically, the present invention includes a plug 12 as best illustrated in FIG. 3. The plug is circular and planar in structure. It is formed of a generally rigid plastic material. The plug has a fixed diameter. Furthermore, the plug has an upper surface 14, lower surface 16, and a peripheral edge 18 perpendicularly interconnecting the surfaces and thereby defining a thickness 20 as shown in FIG. 2. The plug also has an axial threaded bore 22 disposed therethrough as shown in FIG. 5. The plug also includes a straight cylindrical guide pin 24 coupled thereto and extended upwards from the upper surface as shown in FIG. 3. The plug has a diameter allowing it to be snugly received within a thumb hole of a bowling ball 26 as best illustrated in FIG. 2. When secured within a thumb hole of a bowling ball, the lower surface 16 and peripheral edge 18 of the plug are in facing contact with adjacent corresponding surfaces of a bowling ball that are located adjacent to its thumb hole.

Figure 1:
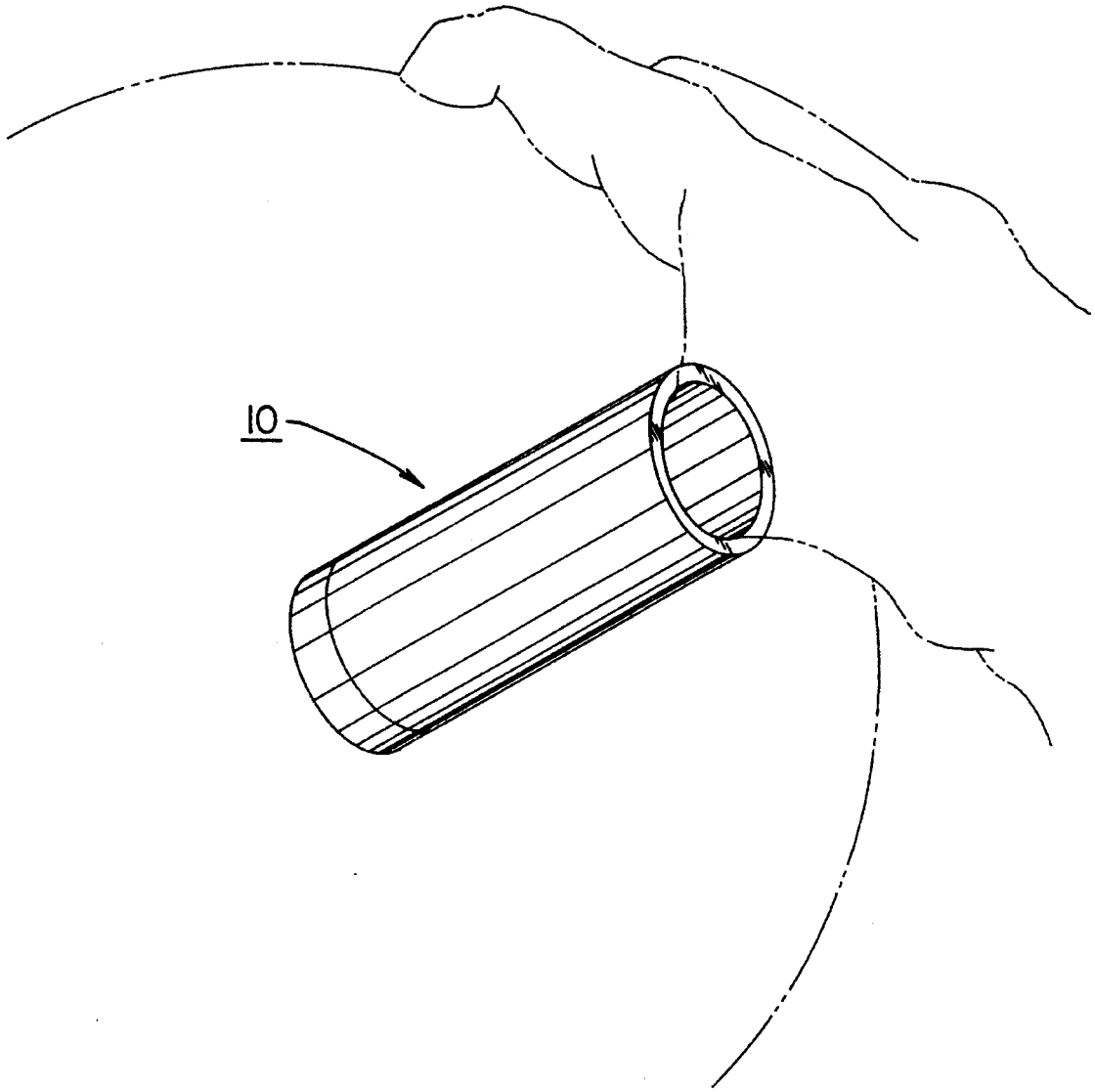
FIG. 1 is a perspective view of the preferred embodiment of the removable bowling ball thumb insert constructed in accordance with the principles of the present invention.

Also provided are a first sleeve 30, a second sleeve 32, a third sleeve 34, and a fourth sleeve 36 as illustrated in FIGS. 6–9. As shown in FIG. 3, each sleeve has a circular planer bottom wall 38 with an interior top surface 40, and exterior bottom surface 42, and a peripheral edge 43 perpendicularly extended between the surfaces. Each sleeve is formed of a plastic material. Each sleeve has an axial threaded bore 44 disposed therethrough. Also provided on each sleeve is a cylindrical recess 46 formed on the exterior surface 42 at a location for snugly receiving the guide pin 44 therein as shown in FIG. 5. In this coupled configuration, the peripheral edge 18 of the plug is positioned flush with the peripheral edge 43 of the sleeve. Each sleeve also includes a tubular side wall 48. The side wall has a circular cross-section and a length at least 10 times greater than the thickness 20 of the plug. Each side wall also has an interior diameter, a fixed exterior diameter equal to the diameter of the bottom wall 38, and interior surface 50, and an exterior surface 52. Each sleeve also has a thickness 54 defined as a tangential distance between the interior surface 50 and the exterior surface 52 thereof. Each sidewall of each tube also has a lower edge 56 integral with the interior surface 40 of the bottom wall. Furthermore, each tube has an upper edge 58 shaped to conform and remain flush with the radius of curvature of a rolling surface 59 of a bowling ball 26 as best illustrated in FIG. 2. Each sleeve is slidably and frictionally positioned within a thumb hole of bowling ball for receipt of a bowler's thumb as shown in FIG. 1. Furthermore, as depicted in FIGS. 6–9, the side wall of the first sleeve has a thickness of about 1/64 inch, the side wall of the second sleeve has a thickness of about 2/64 inch, the side wall of the third sleeve has a thickness of about 3/64 inch, and the side wall of the fourth sleeve has a thickness of about 4/64 inch. Several more sleeves can be provided with each sleeve having a thickness 1/64 inch greater than a successive sleeve.

A washer 60 is also provided. The washer is annularly shaped and planar in structure. It is formed of a rigid plastic material. The washer is disposed within the sleeve 36 and upon the top surface 40 of the bottom wall. The washer is axially aligned with the bore 44 of the sleeve as shown in FIG. 5.

Lastly, a bolt 70 is used for securing the plug and one of the sleeves to a bowling ball. The bolt is formed of a rigid material such as metal or plastic. The bolt has a hexagonal head 72 for allowing ready receipt of a wrench. The bolt also has an elongated threaded portion 76. The threaded portion is extended outwards from the head. Furthermore, when positioned in a coupling configuration, the threaded portion is extended through the washer 60, threadedly extended through a bore 44 of one of the sleeves and the bore 22 of the plug, and then projected outwards from the lower surface of the plug. In this configuration, the bolt can now be threadedly secured to a complementary threaded bore 80 formed at the bottom end of a thumb hole of a bowling ball 26 as shown in FIG. 2.

The present invention provides inserts for use in a thumb hole of a bowling balls. The inserts allow a bowler to easily change the diametric extent of the thumb hole as needed. In particular, the inserts are used to compensate for temporary swelling of a bowler's thumb that slowing occurs in competitions. The inserts are made of plastic that has a thermal expansion coefficient equal or similar to that of the corresponding bowling ball. Each insert is made be made in two pieces, one being a semi-permanent short plug with a hole through the center which is inserted into the bottom of a thumb hole in a bowling ball and held in place to prevent from moving. A rigid guide pin extends about ¼ inch above the plug to fit into a hole provided in the bottom of the sleeve, which is tubular in shape with a solid flat bottom wall. The sleeve has a matching hole in its center to receive a bolt that passes through sleeve and plug and into a threaded bore that has been tapped into bottom of the hole of the bowling ball. A screw and a flat washer clamp the plug and sleeve within a thumb hole of a bowling ball to prevent it from moving. The sleeve is trimmed to coincide with the curved size of the ball, which is due to the thumb hole not being radially located. The thickness of the sleeves vary in about 1/64 inch increments with respect to their interior diameters.

Since a bowler's thumb will swell during competition, the sleeves allow the diametric extend of a thumb hole to be quickly changed. This enables a bowler to release a bowling ball easily and smoothly at all times, despite slow thumb swelling. The present invention can be transferred to other balls if needed and will be much more reliable than using conventional adhesive tape for making thumb hole diameter changes.

Currently, bowlers need to tape their thumb holes to compensate for the swelling and unswelling of their thumbs. Thumbs change sizes, sometimes several times per series. Tape must be removed when a bowler's thumb is getting swelling. If a bowler has several pieces of tape in a thumb hole of a bowling ball, it is difficult hard ascertain the current diameter of the hole or how much tape should be removed from the hole to compensate for thumb swelling. Often, removal or addition of a portion of tape from a thumb hole for compensation purposes proves inadequate, and before another shot is made, more tape needs to be removed or added. If a bowler's thumb starts to feel smaller, as is a common occurrence between the start and end of the first game, tape must be added. Therefore, a bowler spends too much time worrying about the correct thumb size, and this bowler's concentration on the game at hand is diminished or even broken.

Adding tape in a thumb hole of a bowling ball can be a tricky business. Tape must be placed in the exact right position within the thumb hole to get the right feel. To further complicate matters, when the tape is removed, it leaves adhesive which could cause a bowler to make a bad shot on the next approach. To be sure, the inherent ambiguity of thumb hole taping has caused problems for many bowlers. To alleviate these problems, the present invention provides four inserts which are each 1/64 inch of a diameter in difference for installation as necessary during a game.

Furthermore, with the constant changing of ball to ball within a series as is presently performed, another problem is created. When a bowler goes to another ball to get a better lane reaction, he can not be sure that his first release with the new ball will feel right. He may have added or taken tape out of the ball he had been using, but hasn't with the ball he is now going to roll. Bad shots are often the result. A bowler strives try to keep his thumb holes the same size, but it is an ambiguous process at best. With the present invention, a bowler can be sure of a consistent release with every shot.

There are severally commercially available thumb hole inserts. However, they are glued within a thumb hole of a bowling ball and can't be removed without a great deal of effort. Also, when using conventional inserts, it is necessary to leave some of its length protruding out of the ball. Then, this length must be cut off. This is due to the fact that most thumb holes do not point to the center of the ball. Balls have different pitches, reserve and side, meaning the inserts will not end up flush with the outside of the drilled thumb hole. The inserts must be left long and excess severed to the contour of the ball. Although this is true with the present invention, the arrangement of the guide pin and hole between the mounting plug and body allows perfect alignment upon reinstallation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A bowling ball thumb insert removably secured within a constant diameter elongated thumb hole in a bowling ball for allowing the diametric extent of the thumb hole to be changed, the bowling ball thumb insert comprising, in combination:

a rigid circular planar plug having a fixed diameter, an upper surface, a lower surface, a peripheral edge perpendicularly interconnecting the surfaces and thereby defining a thickness, an axial threaded bore disposed therethrough, and a straight cylindrical guide pin coupled thereto and extended upwards from the upper surface, the plug further having a diameter allowing it to be snugly received within a thumb hole of a bowling ball and with the lower surface and peripheral edge thereof in facing contact with adjacent corresponding surfaces of a bowling ball located adjacent to its thumb hole;

a first, a second, a third, and a fourth rigid sleeve, each sleeve having a circular planar bottom wall with an interior top surface, an exterior bottom surface, a peripheral edge perpendicularly extended between the surfaces, an axial threaded bore disposed therethrough, a cylindrical recess formed on the exterior surface at a location for snugly receiving the guide pin of the plug therein, and a tubular side wall having a circular cross section, a length at least ten times greater than the thickness of the plug, an interior diameter, a fixed exterior diameter equal to the diameter of the bottom wall, an interior surface, an exterior surface, a thickness defined as a tangential distance between the interior surface and the exterior surface, a lower end integral with the interior surface of the bottom wall, and an upper end shaped to conform and remain flush with the radius of curvature of a rolling surface of a bowling ball, each sleeve slidably frictionally positionable within a thumb hole of a bowling ball, the first sleeve having a sidewall with a thickness of about 1/64 inch, the sidewall of the second sleeve having a thickness of about 2/64 inch, the sidewall of the third sleeve having a thickness of about 3/64, and the sidewall of the fourth sleeve having a thickness of about 4/64 inch;

a rigid planar washer disposed within the sleeve upon the top surface of the bottom wall and axially aligned with the bore thereof; and a rigid bolt having a hexagonal head with an elongated threaded portion extended outwards therefrom and with the threaded portion extended through the washer and threadedly extended through a bore of one of the sleeves and the bore of the plug, the threaded portion of the bolt further projected outwards from the lower surface of the plug for threaded securement to a complimentary threaded bore formed at a bottom end of a thumb hole of a bowling ball.

2. A bowling ball thumb insert securable within a hole in a bowling ball for allowing an outer extent of the hole to be changed, the bowling ball thumb insert comprising:

a generally planar plug having an upper surface, a lower surface, a peripheral edge interconnecting the surfaces and thereby defining a thickness, and a bore disposed therethrough and with the plug positionable within a thumb hole of a bowling ball;

a plurality of sleeves, each sleeve having a circular planar bottom wall with an interior top surface, an exterior bottom surface, a peripheral edge extended between the surfaces, a bore disposed therethrough, and a tubular side wall having a characteristic thickness, an upper end, and a lower end with the lower end coupled with the interior surface of the bottom wall; and a bolt extended through the bore of a sleeve and the bore of the plug, the bolt further projected outwards from the lower surface of the plug for threaded securement to a complimentary threaded bore formed at a bottom end of a thumb hole of a bowling ball.

3. The bowling ball insert as set forth in claim 2:

wherein a first, a second, a third, and a fourth sleeve are included; and wherein the sidewall of the first sleeve has a set thickness, the sidewall of the second sleeve has a thickness at least 1/64 inch greater than the thickness of the first sleeve, the sidewall of the third sleeve has a thickness at least 1/64 inch greater than the thickness of the second sleeve, and the sidewall of the fourth sleeve has a thickness at least 1/64 inch greater than the thickness of the third sleeve.

4. The bowling ball insert as set forth in claim 2 further including:

a guide pin coupled to the upper surface of the plug and extended upwards therefrom; and a recess formed on the exterior surface of the bottom wall of each sleeve at a location for snugly receiving the guide pin.

5. The bowling ball insert as set forth in claim 2 wherein the lower surface and peripheral edge of the plug are positionable in facing contact with adjacent corresponding surfaces of a bowling ball located adjacent to its thumb hole.

6. The bowling ball insert as set forth in claim 2 wherein each sleeve has a length at least ten times greater than the thickness of the plug.

7. The bowling ball insert as set forth in claim 2 a rigid planar washer coupled between the plug and sleeve.

8. The bowling ball insert as set forth in claim 2 wherein the exterior surface of each sleeve is slidably frictionally positionable in facing contact with an adjacent corresponding surface of a bowling ball located adjacent to its thumb hole.

9. The bowling ball insert as set forth in claim 2 wherein the upper end of the sleeve is shaped to conform with the radius of curvature of a rolling surface of a bowling ball.

10. The bowling ball insert as set forth in claim 2 wherein the sidewall of each sleeve has a fixed exterior diameter equal to the diameter of the bottom wall thereof.

* * * * *